US005532912A

United States Patent [19]

Bendit

[11] Patent Number: 5,532,912

[45] Date of Patent: Jul. 2, 1996

[54] CLAMPSHADE

[76] Inventor: Barbara G. Bendit, One Jared La., Manalapan, N.J. 07726

[21] Appl. No.: 410,671

[22] Filed: Mar. 27, 1995

[51] Int. Cl.[6] ..... F21V 1/06

[52] U.S. Cl. ..... 362/352; 362/357; 362/358

[58] Field of Search ..... 362/351, 352, 362/356, 357, 358, 360

[56] References Cited

U.S. PATENT DOCUMENTS

| | | | |
|---|---|---|---|
| 1,660,883 | 2/1928 | Ober | 362/357 |
| 2,435,759 | 2/1948 | Spaw | 362/358 |
| 2,819,386 | 1/1958 | Linderoth | 362/358 |
| 2,948,198 | 8/1960 | Freunlich | 362/358 |
| 4,055,760 | 10/1977 | Weisbrod | 362/352 |
| 4,212,052 | 7/1980 | Chambard | 362/358 |
| 4,772,992 | 9/1988 | Tang | 362/352 |

*Primary Examiner*—James C. Yeung
*Assistant Examiner*—Alfred Basichas
*Attorney, Agent, or Firm*—Charles I. Brodsky

[57] ABSTRACT

An easily manufactured, inexpensive lamp shade dressing kit that secures decorative material of the user's choosing to a manufactured lamp shade in a non-destructive, visually non-obvious manner, permitting the subsequent removal or exchange of the material, when desired.

10 Claims, 1 Drawing Sheet

CLAMPSHADE

FIELD OF THE INVENTION

This invention relates to the modification of manufactured lamp shades, and more particularly, to a lamp shade dressing kit which makes the customization of a lamp shade's decor an easy, non-destructive procedure.

1. Background of the Invention

As is well known, manufactured lamp shades generally come prepackaged with lamps, and are typically of a solid white color or some variation thereof. Lamp shades that are sold independently of lamps generally come in the same color and pattern as those that come included with lamps—not allowing for creativity. This makes the coordination of a lamp shade's color with the remainder of the room's decor a frustrating exercise—unless one desires it to be "white". However, it is often desired to have the lamp shade covered in a material identical to other pieces of furniture or accessories in the room—whether they be couches, curtains, pillows or bedding. To deal with this problem, others in the field have offered lamp shade modification kits for the securement of user selected fabrics.

Most of these kits require the user to glue the desired fabric to a manufactured lamp shade, thereby permanently altering it. A problem exists furthermore, when using glue, in that it is very important to have the fabric perfectly aligned with the lamp shade prior to adhesion because, otherwise, subsequent adjustment is difficult or even destructive to the fabric and/or lamp shade. The glue, additionally, affects the translucency of the lamp shade and is visible when the lamp is on, thereby defeating any visual enhancement the decorative fabric may have added. An additional problem that exists with kits that employ the use of glue is that 2. Field Of The Invention This invention relates to the modification of manufactured lamp shades, and more particularly, to a lamp shade dressing kit which makes the customization of a lamp shade's decor an easy, non-destructive procedure.

BACKGROUND OF THE INVENTION

As is well known, manufactured lamp shades generally come prepackaged with lamps, and are typically of a solid white color or some variation thereof. Lamp shades that are sold independently of lamps generally come in the same color and pattern as those that come included with lamps—not allowing for creativity. This makes the coordination of a lamp shade's color with the remainder of the room's decor a frustrating exercise unless one desires it to be "white". However, it is often desired to have the lamp shade covered in a material identical to other pieces of furniture or accessories in the room—whether they be couches, curtains, pillows or bedding. To deal with this problem, others in the field have offered lamp shade modification kits for the securement of user selected fabrics.

Most of these kits require the user to glue the desired fabric to a manufactured lamp shade, thereby permanently altering it. A problem exists furthermore, when using glue, in that it is very important to have the fabric perfectly aligned with the lamp shade prior to adhesion because, otherwise, subsequent adjustment is difficult or even destructive to the fabric and/or lamp shade. The glue, additionally, affects the translucency of the lamp shade and is visible when the lamp is on, thereby defeating any visual enhancement the decorative fabric may have added. An additional problem that exists with kits that employ the use of glue is that a subsequent desire to return to the original lamp shade color is impossible since the glue is destructive to the underlying lamp shade.

Other kits of similar types use elastic and draw strings as a means for securing fabric to the manufactured lamp shade. These require the user to have access to a sewing machine and possess some amount of skill. In these kits, a person is required to sew the fabric in such a way so as to create a channel along the top and bottom of the fabric and subsequently feed either the elastic or string through that channel. Needless to say, it is a difficult, time consuming process to work either of these through a long narrow cloth channel. Once the elastic, or string is fed through the channel, the user ties it off over the lamp shade so that the resulting opening of the decorative fabric is smaller than that of the manufactured lamp shade—thereby keeping it in place. Since the resulting opening is smaller than the manufactured lamp shade opening, there exists an overhang of fabric at both the top and bottom which is visible to the viewer. Additionally, since the fabric is not anchored to the elastic or string itself, it is common for it to bunch up, or spread out in a non-uniform manner—again minimizing any visual enhancement—and to shift about over time.

As will be appreciated, these manners of attaching fabric to a manufactured lamp shade do not permit the quick interchange of fabrics to view various combinations. The existing art also does not contemplate the use of non-fabric materials—such as paper —as a decorative cover, in that the means for attachment are not appropriate to use on less pliable, water soluble materials.

OBJECTS OF THE INVENTION

It is an object of the present invention to provide a new, inexpensive, attractive, durable, reusable method of securing decorative materials to a manufactured lamp shade so as to overcome the limitations of prior arrangements.

It is another object of the present invention to substantially reduce the amount of time needed to secure decorative materials to a manufactured lamp shade.

It is a further object of the present invention to secure such materials to a manufactured lamp shade in such a manner as not to be obvious to the viewer that the shade has been modified.

It is an additional object of the invention to permit the removal and interchange of materials in such a manner as to not to blemish the underlying lamp shade.

SUMMARY OF THE INVENTION

As will become clear from the description that follows, the lamp shade dressing kit of the invention is in the nature of a decoratively attractive, inexpensively priced strip designed to securely connect a variety of materials to a manufactured lamp shade in such a manner as to be non-destructive. As will also become clear, the kit of the invention may be, generally constructed in the form of a semi-rigid plastic strip having a Vee cross-section which, when properly cut and joined, form separate upper and lower hoops of a dimension marginally larger than that of the upper and lower rims of the manufactured lamp shade. As will further become clear, the upper and lower hoops are secured to the manufactured lamp shade by a multiplicity of projections which clamp over the upper rim and under the lower rim. In a preferred embodiment, the outer wall of the Vee cross-section strip is of taller dimension than the inner wall so as to hide the projections from sight once the kit is installed.

BRIEF DESCRIPTION OF THE DRAWING

These and other features of the invention will be more clearly understood from a consideration of the following description, taken in connection with the accompanying drawing, in which.

DETAILED DESCRIPTION OF THE DRAWING

Figure 1:
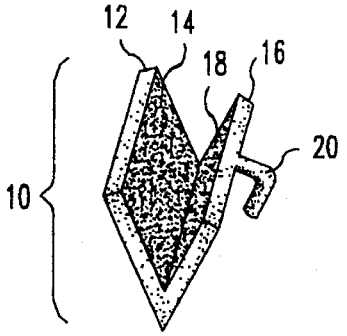
FIG. 1 is a lateral view of an upper strip showing a projection, an outer wall, inner wall, and adhesives for securement in accordance with the invention.

In FIG. 1, an upper strip 10, is shown as having an outer wall 12 with an adhesive strip 14. Extending upwardly from the bottom of the outer wall 12, is an inner wall 16,—also having an adhesive strip 18—which has a plurality of projections along its length which are bendable so as to clamp onto the upper rim 28, of a manufactured lamp shade 30. The outer wall 12, is of a taller dimension than that of the inner wall 16, so as to conceal the projections from view upon installation.

Figure 2:
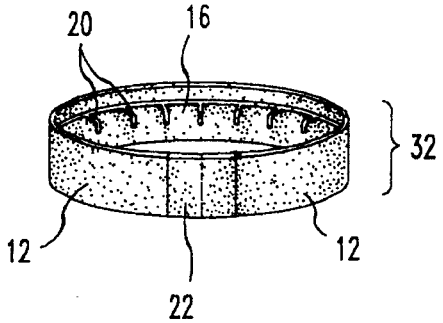
FIG. 2 is a front view of the upper strip secured to form the upper hoop of the invention.

In FIG. 2, the upper strip 10 is shown with the ends of its outer wall 12, being joined to each other by a securing means 22, so as to form the first upper hoop 32. Additionally, the projections 20, and the inner wall 16, are shown as being properly oriented.

Figure 3:
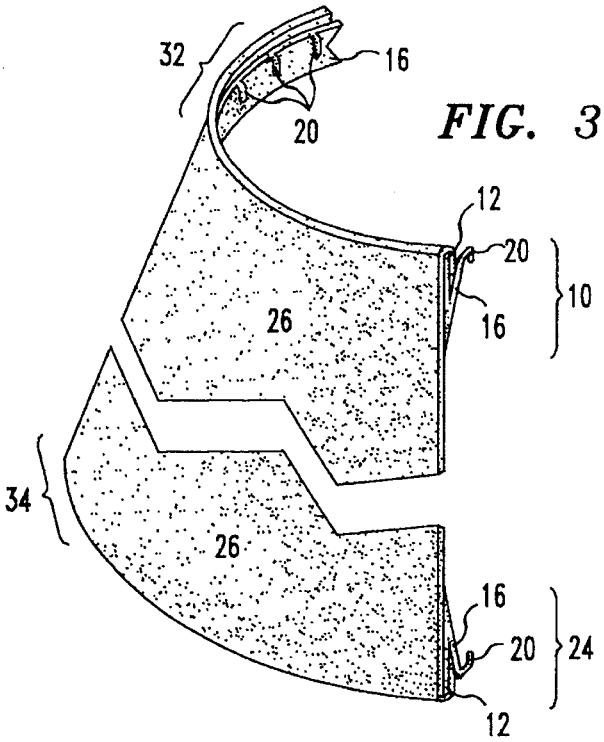
FIG. 3 is a cut-away view of the upper and lower hoops with a decorative material installed.

In FIG. 3, the upper strip 10, is shown with its Vee cross-section walls 12 and 16 facing upwardly, and the projections 20, being situated to the inside of the resulting hoop 32, extending downwardly. A decorative material 26, is shown as originating between the inner wall 16, and the outer wall 12, where it is secured by pressing between the interior surfaces—in addition to the adhesive strips 14, and 18 thereon. The decorative material 6, then drapes over the top of the outer wall 12, until it reaches the lower strip 24,—where the process reverses. That is, the lower strip 24, is shown with its Vee cross-section walls 2 and 16 facing downwardly, and the projections 20 extending upwardly.

Figure 4:
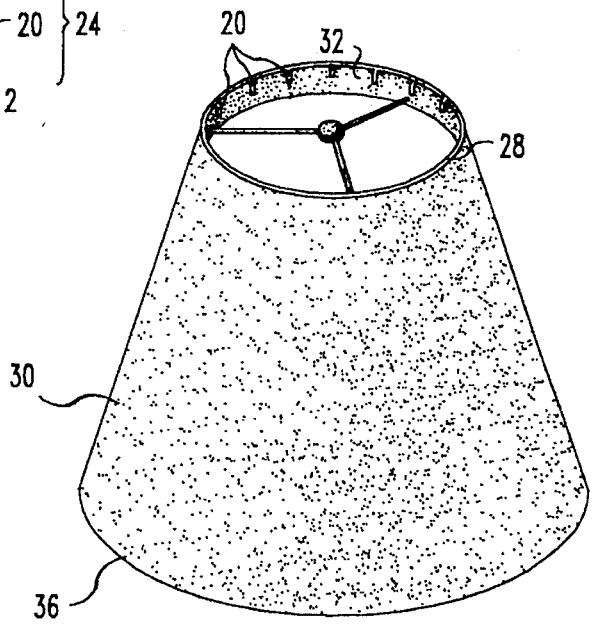
FIG. 4 is a front view of the kit as installed on a manufactured lamp shade.

In FIG. 4, a manufactured lamp shade 30, is shown with the invention installed. As is obvious, the only evidence of a modification are the projections 20, which are clamped over the upper rim 28, and under the lower rim 36. Neither the projections 20, on the first upper hoop 32, or the second lower hoop 34, are visible from a lateral perspective.

In the use of the invention, when a homeowner, renter, crafts-person, or decorator is selecting the decor for a room—be it a residence or commercial space—he or she can select an appropriate material to match the lamp shade to the rest of the room and not concern herself with which lamp shades come in which colors. To use the lamp shade dressing kit, the user takes the upper strip 10, and cuts it to a length marginally greater than the circumference of the upper rim 28,—allowing the upper strip 10, to fit around the upper rim 28. The user then takes the lower strip 24, and cuts it to a length marginally greater than the circumference of the lower rim 36,—allowing the lower strip 24, to fit around the lower rim 36. The user then simply selects a piece of material 26,—fabric or otherwise—and cuts it slightly larger than the dimensions of the manufactured lamp shade which he wants to decorate. The top of the material 26, is then inserted into the upper strip 10,—which is in an upright orientation—between the inner wall 16, and the outer wall 12, which are subsequently compressed,—thereby causing the adhesive strips 14, and 18 to contact the material 26,—securing it in place. The material is then draped over the top of the outer wall 2, subsequently draping the bottom end of the material 26, over the outer wall 12, of the lower strip 24,—which is in a downward orientation. The material 26, is then inserted into the lower strip 24, between the inner wall 16, and the outer wall 12, which are compressed,—causing the adhesive strips 14, and 18 to contact the material 26,—thereby securing it in place. With the material 26, securely in place, the user bends the ends of the upper strip 10 so as to form a first upper hoop 32, which is then joined by any appropriate securing means 22,—making sure the inner wall 16, and the projections 20, are oriented to the inside of the hoop. The user then bends the ends of the lower strip 24, so as to form the second hoop 34, which is then joined by its own securing means 22,—making sure that the inner wall 16, and the projections 20, are oriented to the inside of the hoop. With the inner wall 16, oriented to the inside, the outer wall—being of a taller dimension—hides both the inner wall and the upwardly and downwardly projections 20 from sight,—thereby increasing its attractiveness. The completed dressing is then slid over the top of the manufactured lamp shade 30, until the first hoop 32, and the second hoop 34, are fitted around the top rim 28, and the bottom rim 36, respectively. The final step is for the user to bend the projections 20, around the top rim 28 and the bottom rim 36 to secure them in place. If the user decides that he or she does not like the appearance of the modified lamp shade,—or changes the decor of the room in the future—the kit can be easily removed by unclamping the projections 20, from the top rim 28 and the bottom rim 36, and sliding it off. If the user would like to try a different material it is a simple as separating the inner wall 16, and the outer wall 12 to remove the existing material and replace it with a second material in the same manner as originally performed.

While there have been described what are considered to be preferred embodiments of the present invention, it will be readily appreciated by those skilled in the art that modifications can be made without departing from the scope of the teachings herein. Thus, whereas, a semi-rigid plastic strip has been depicted, it will be appreciated that any other appropriate materials can be employed. Additionally, while a projection that is integrated into the strip at manufacture has been described, it will be understood that user installed projections can be employed thereby simplifying the manufacturing process, and reducing the price of manufacture, and still carry out the principles underlying the invention. For at least such reasons, therefore, resort should be had to the claims appended hereto for a true understanding of the scope of the invention.

I claim:

1. A dressing kit for receiving a fabric to cover over the existing shade of a lamp shade frame of the type having an upper rim, a lower rim and a shade extending therebetween, comprising: an upper strip forming a first hoop for clamping to said upper rim of said lamp shade frame, and a lower strip forming a second hoop for clamping to said lower rim of said lamp shade frame; wherein said upper strip is of an upwardly facing Vee cross-section having a first pair of facing walls and a plurality of downwardly extending projections; wherein said lower strip is of a downwardly facing Vee cross-section having a second pair of facing walls and a plurality of upwardly extending projections; wherein said plurality of downwardly extending projections of said upper strip are positionable to clamp to said upper rim of said lamp shade frame; and wherein said plurality of upwardly extending projections of said lower strip are positionable to clamp to said lower rim of said lamp shade frame; a first adhesive means between said first pair of facing walls; a second adhesive means between said second pair of facings walls; wherein said first pair of facing walls are deformable towards one another to adhesively secure a top of said cover fabric to be received; and wherein said second pair of facing walls are deformable towards one another to adhesively secure a bottom of said cover fabric to be received.

2. The dressing kit of claim 1, wherein said first pair of facings walls include an inner wall and an outer wall, and wherein said inner wall of said first pair of facing walls is of a shorter length than said outer wall of said first pair of facing walls.

3. The dressing kit of claim 2, wherein said second pair of facing walls also include an inner wall and an outer wall, and wherein said inner wall of said second pair of facing walls is of a shorter length than said outer wall of said second pair of facing walls.

4. The dressing kit of claim 3, wherein said plurality of downwardly extending projections originate at said inner wall of said first pair of facing walls.

5. The dressing kit of claim 4, wherein said plurality of upwardly extending projections originate at said inner wall of said second pair of facing walls.

6. The dressing kit of claim 1, wherein there is also included a fabric extending between said first and said second pairs of facings walls to overlie said shade of said lamp shade frame.

7. The dressing kit of claim 1, wherein said plurality of upwardly and downwardly extending projections are bendable and adjustable to fit over said upper and lower rims of said lamp shade frame independent of the thickness thereof.

8. The dressing kit of claim 1, wherein said first and second adhesive means are each releasably adhesive to permit removal of said received cover fabric for the replacement thereof.

9. The dressing kit of claim 8, wherein said first and second means include a hook-and-loop adhesive fastener.

10. The dressing kit of claim 9, wherein said hook-and-loop adhesive fasteners extend continuously between said first and said second pairs of facing walls along the lengths thereof.

* * * * *

UNITED STATES PATENT AND TRADEMARK OFFICE

CERTIFICATE OF CORRECTION

PATENT NO. : 5,532,912
DATED : July 2, 1996
INVENTOR(S) : Barbara G. Bendit

It is certified that error appears in the above-indentified patent and that said Letters Patent is hereby corrected as shown below:

| | |
|---|---|
| Col.1, Lines 10-42 | delete "1.Background.....procedure." |
| Col.3, Line 46 | change "material 6" to -- material 26-- |
| Col.3, Line 49 | change "walls 2" to -- walls 12 -- |
| Col.4, Line 11 | change "wall 2" to -- "wall 12-- |
| Col.4, Line 44 | after "performed." insert -- In this respect, it will be appreciated that adhesive strips 14 and 18 may each consist of a double-sided adhesive tape of any well known existence -- |
| Col.6, Line 21 | change "hook-and-loop" to -- double-sided tape -- |

UNITED STATES PATENT AND TRADEMARK OFFICE

CERTIFICATE OF CORRECTION

PATENT NO. : 5,532,912
DATED : July 2, 1996
INVENTOR(S) : Barbara G. Bendit

It is certified that error appears in the above-indentified patent and that said Letters Patent is hereby corrected as shown below:

Col. 6, Lines 22-23 change "hook-and-loop" to -- double-sided tape--

Signed and Sealed this

Eleventh Day of March, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,532,912
DATED : 02 July 1996
INVENTOR(S) : BARBARA G BENDIT

It is certified that error appears in the above-indentified patent and that said Letters Patent is hereby corrected as shown below:

On the title page, please replace the title "Clampshade" with --Lampshade Dressing Kit--.

Signed and Sealed this
Twenty-fifth Day of January, 2000

*Attest:*

*Attesting Officer*

*Acting Commissioner of Patents and Trademarks*